US009589518B2

(12) United States Patent
Onishi

(10) Patent No.: US 9,589,518 B2
(45) Date of Patent: Mar. 7, 2017

(54) DISPLAY DEVICE

(71) Applicant: Panasonic Liquid Crystal Display Co., Ltd., Himeji-shi, Hyogo (JP)

(72) Inventor: Toshiki Onishi, Osaka (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 375 days.

(21) Appl. No.: 14/199,608

(22) Filed: Mar. 6, 2014

(65) Prior Publication Data

US 2015/0070411 A1 Mar. 12, 2015

(30) Foreign Application Priority Data

Sep. 6, 2013 (JP) ..... 2013-185330

(51) Int. Cl.
*G09G 5/02* (2006.01)
*G09G 3/36* (2006.01)

(52) U.S. Cl.
CPC ... *G09G 3/3648* (2013.01); *G09G 2320/0233* (2013.01); *G09G 2320/0285* (2013.01)

(58) Field of Classification Search
CPC ... G09G 2320/0233; G09G 2320/0285; G09G 3/3648
See application file for complete search history.

(56) References Cited

U.S. PATENT DOCUMENTS

2004/0125322 A1* 7/2004 Sawasaki ..... G02F 1/13394 349/156
2010/0328359 A1* 12/2010 Inoue ..... G09G 3/2077 345/690

FOREIGN PATENT DOCUMENTS

JP 10-068955 3/1998

* cited by examiner

*Primary Examiner* — Kumar Patel
*Assistant Examiner* — Insa Sadio
(74) *Attorney, Agent, or Firm* — Hamre, Schumann, Mueller & Larson, P.C.

(57) ABSTRACT

A display device includes a display portion comprising pixels including a first pixel and a second pixel, a source driver for applying a pixel voltage to pixels through signal lines, and a control portion for controlling the source driver. The first and second pixels each include a first sub-pixel and a second sub-pixel. The first sub-pixel includes a light exit portion and a color filter for a first hue. The second sub-pixel includes a light exit portion and a color filter for a second hue. An area of the light exit portion of the first sub-pixel of the first pixel is smaller than that of the first sub-pixel of the second pixel. The control portion converts the video signal for the first sub-pixel into a brighter one. The source driver applies the pixel voltage to the first sub-pixel of the first pixel based on the video signal after conversion.

11 Claims, 9 Drawing Sheets

FIG.6

| | | BLUE SUB-PIXEL | RED SUB-PIXEL | GREEN SUB-PIXEL | COLOR INFORMATION |
|---|---|---|---|---|---|
| STATUS OF VIDEO SIGNAL | INPUT STATUS | 252 | 250 | 100 | BLUE, RED, GREEN |
| | AFTER FIRST PROCESSING | 315 | 250 | 100 | RED, GREEN |
| | AFTER SECOND PROCESSING | 255 | 261 | 107 | GREEN |
| | AFTER THIRD PROCESSING | 255 | 255 | 111 | GREEN |
| | AFTER CONVERSION IS FINISHED | 255 | 255 | 111 | GREEN |

DISPLAY DEVICE

CROSS-REFERENCE TO RELATED APPLICATION

The present application claims priority from the Japanese Application JP 2013-185330 filed on Sep. 6, 2013, the content of which is hereby incorporated by reference into this application.

TECHNICAL FIELD

The present invention relates to a display device.

BACKGROUND

In general, a display device includes a spacer for maintaining an interval between a so-called thin film transistor (TFT) substrate and a so-called counter substrate opposed to the TFT substrate. Here, Japanese Patent Application Laid-open No. Hei 10-68955 discloses that the spacer is provided to a source electrode region of a TFT in order to prevent the spacer from reducing an aperture ratio.

SUMMARY

However, it is difficult to provide a spacer only to the above-mentioned source electrode region as pixel resolution is becoming higher in recent years. In this case, the spacer can be provided so as to cover a part of an aperture region of a pixel, but such placement causes a reduction in luminance, display unevenness, and the like.

The present invention has been made in view of the above-mentioned problem, and an object thereof is to provide a display device capable of reducing, for example, a reduction in luminance and display unevenness as described above.

In one general aspect, the present application describes a display device that includes a display portion in which a plurality of pixels comprising a first pixel and a second pixel are arranged in a matrix shape; a source driver for applying a pixel voltage to the plurality of pixels through a plurality of signal lines; and a control portion for controlling the source driver based on a video signal input from outside, the first pixel and the second pixel each comprising a first sub-pixel and a second sub-pixel. The first sub-pixel includes a light exit portion from which light exits; and a color filter for a first hue. The second sub-pixel includes the light exit portion; and a color filter for a second hue. An area of the light exit portion included in the first sub-pixel of the first pixel is smaller than an area of the light exit portion included in the first sub-pixel of the second pixel; the control portion converts, when the video signal input to the first sub-pixel of the first pixel is less than a predetermined value, the video signal input to the first sub-pixel of the first pixel into a video signal exhibiting a luminance higher than a luminance exhibited by the video signal input to the first sub-pixel; and the source driver applies the pixel voltage to the first sub-pixel of the first pixel based on the video signal after conversion.

The above general aspect may include one or more of the following features. An area of the light exit portion included in the second sub-pixel of the first pixel may be substantially equal to an area of the light exit portion included in the second sub-pixel of the second pixel.

The first pixel and the second pixel each may further include a third sub-pixel different from the first sub-pixel and the second sub-pixel. The third sub-pixel may further include a color filter for a third hue different from the first hue and the second hue. The control portion may convert, when the video signal input to the first sub-pixel of the first pixel after the conversion exceeds the predetermined value, the respective video signals input to the second sub-pixel and the third sub-pixel of the first pixel into respective video signals exhibiting luminances higher than luminances exhibited by the respective video signals input to the second sub-pixel and the third sub-pixel.

The control portion may convert the respective video signals input to the second sub-pixel and the third sub-pixel of the first pixel based on a relationship between the video signal exceeding the predetermined value and the predetermined value.

The control portion may convert, when one of the video signals input to the second sub-pixel and the third sub-pixel of the first pixel after the conversion exceeds a predetermined value, the other of the video signals input to the second sub-pixel and the third sub-pixel into a video signal exhibiting a luminance higher than a luminance exhibited by the other of the video signals.

The control portion may convert the other of the video signals input to the second sub-pixel and the third sub-pixel based on a relationship between the one of the video signals input to the second sub-pixel and the third sub-pixel and the predetermined value.

The control portion may convert, based on a ratio of visibilities of the color filters for the first hue, the second hue, and the third hue, the respective video signals input to the second sub-pixel and the third sub-pixel of the first pixel into respective video signals exhibiting the luminances higher than the luminances exhibited by the respective video signals input to the second sub-pixel and the third sub-pixel.

The first sub-pixel of the first pixel may further include an interference portion for inhibiting the light from exiting. The interference portion may cause the area of the light exit portion of the first sub-pixel of the first pixel to be smaller than the area of the light exit portion of the first sub-pixel of the second pixel.

The first hue may be blue.

The display device may further include a first substrate and a second substrate. The interference portion may be a spacer placed between the first substrate and the second substrate.

The interference portion may be a sensor.

In another general aspect, the display device of the present application includes a display portion in which a plurality of pixels comprising a first pixel and a second pixel are arranged in a matrix shape; a source driver for applying a pixel voltage to the plurality of pixels through a plurality of signal lines; and a control portion for controlling the source driver based on a video signal input from outside, the first pixel and the second pixel each comprising a first sub-pixel and a second sub-pixel. The first sub-pixel includes a light exit portion from which light exits; and a color filter for a first hue. The second sub-pixel includes the light exit portion; and a color filter for a second hue. An area of the light exit portion included in the first sub-pixel of the first pixel is smaller than an area of the light exit portion included in the first sub-pixel of the second pixel; the control portion converts, when the video signal exhibiting a fixed luminance less than a first predetermined value is input from the outside to the first sub-pixel included in each of the first pixel and the second pixel, the video signal input to the first sub-pixel of the first pixel into a video signal exhibiting a luminance higher than a luminance exhibited by the video signal input to the first sub-pixel of the second pixel; and the source driver applies the pixel voltage to the first sub-pixel of the first pixel based on the video signal after conversion.

The above another general aspect may include one or more of the following features. An area of the light exit portion included in the second sub-pixel of the first pixel may be substantially equal to an area of the light exit portion included in the second sub-pixel of the second pixel. The control portion may convert, when the video signal after the conversion which is input to the first sub-pixel of the first pixel is the video signal exhibiting a luminance of the first predetermined value and when the video signal exhibiting a fixed luminance less than a second predetermined value is input to each of the second sub-pixels included in the first pixel and the second pixel, the video signal input to the second sub-pixel of the first pixel into a video signal exhibiting a luminance higher than a luminance exhibited by the video signal input to the second sub-pixel of the second pixel; and the source driver applies the pixel voltage to the second sub-pixel of the first pixel based on the video signal after the conversion.

BRIEF DESCRIPTION OF THE DRAWINGS

FIG. 6 is a table showing an example of a process in which a video signal is converted.

DETAILED DESCRIPTION

Figure 1:
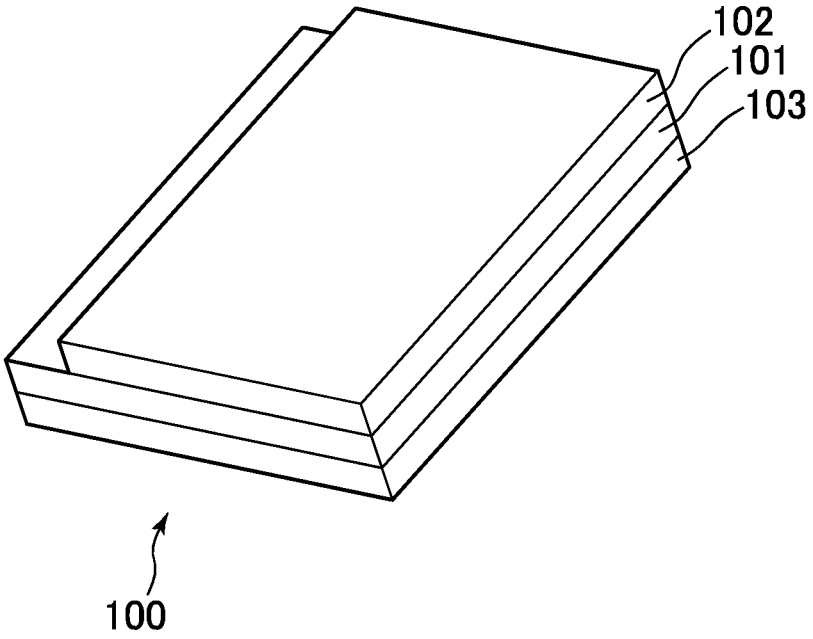
FIG. 1 is a schematic diagram illustrating a display device according to an embodiment of the present application.

FIG. 1 is a schematic diagram illustrating a display device 100 according to an embodiment of the present application. As illustrated in FIG. 1, a display device 100 includes, for example, a TFT substrate 101 and a filter substrate. On the TFT substrate 101, thin film transistors (TFTs) and the like (not shown) are formed. The filter substrate is opposed to the TFT substrate 101 and is provided with color filters (not shown). The display device 100 also includes a liquid crystal layer (not shown) and a backlight unit 103. The liquid crystal layer is sealed in a region sandwiched between the TFT substrate 101 and the color filter substrate 102. The backlight unit 103 is provided on the TFT substrate 101 so as to be held in contact with a surface opposite to the side on which the filter substrate is provided. Note that, an outline of the display device 100 illustrated in FIG. 1 is merely an example, and this embodiment is not limited thereto.

Figure 2:
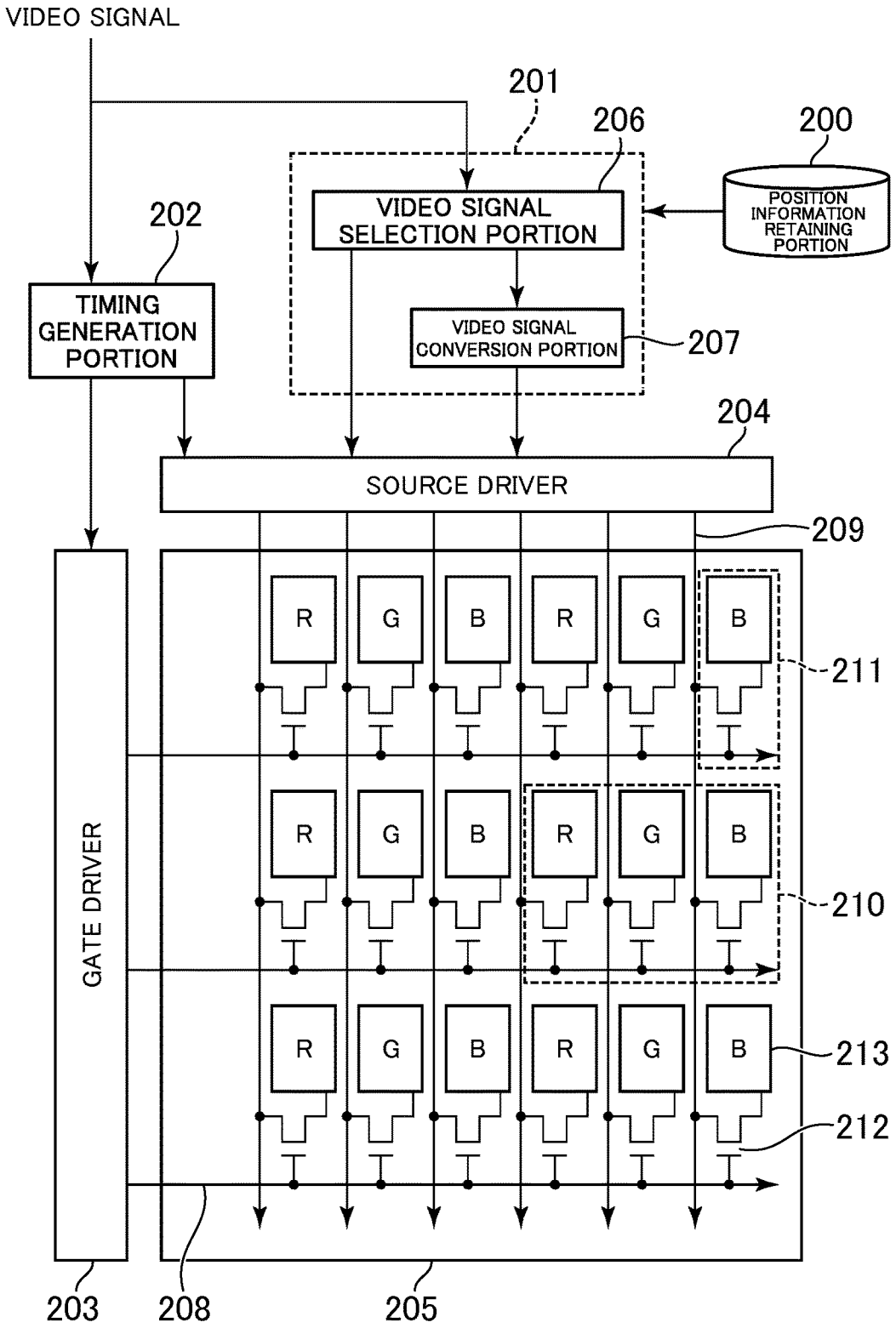
FIG. 2 is aconceptualdiagramofapixelcircuitandaperipheral circuit that are formed on a TFT substrate illustrated in FIG. 1.

FIG. 2 is a conceptual diagram of a pixel circuit formed on the TFT substrate 101 illustrated in FIG. 1. As illustrated in FIG. 2, the display device 100 includes, for example, a position information retaining portion 200, a control portion 201, a timing generation portion 202, a gate driver 203, a source driver 204, and a panel 205. Note that, the position information retaining portion 200 may be provided outside the display device 100.

Figure 3:
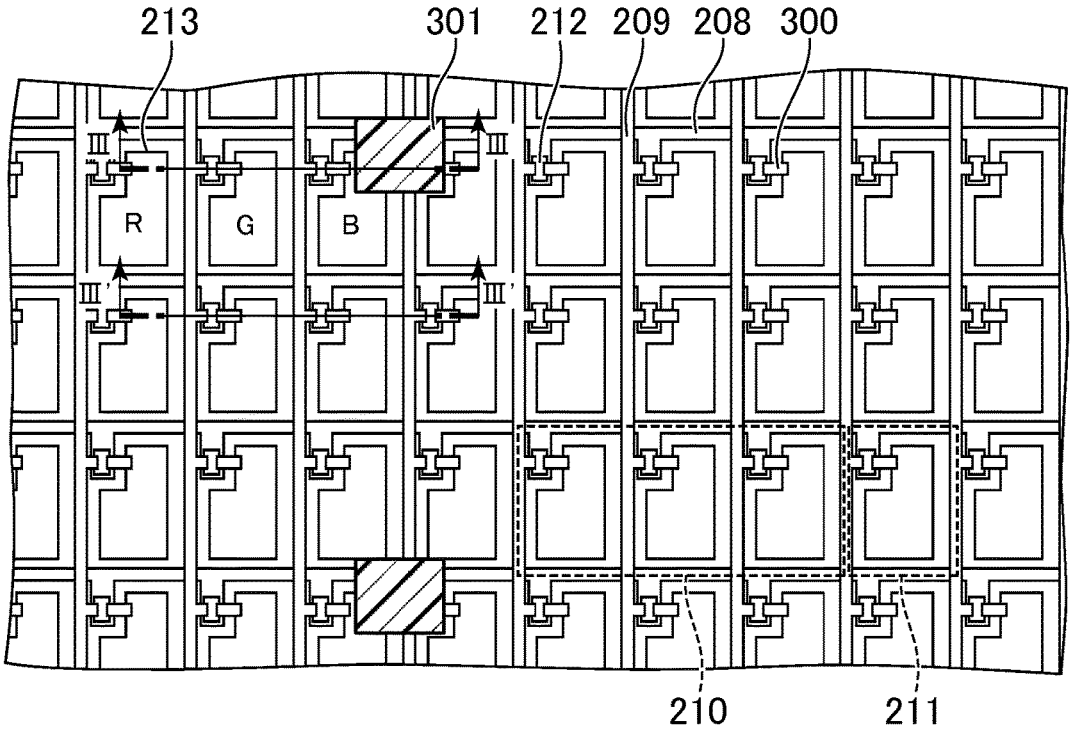
FIG. 3 is a plan view illustrating pixels of a liquid crystal display element according to the embodiment of the present application.

The position information retaining portion 200 retains position information of a sub-pixel 211 in which a spacer described later is placed as illustrated in FIG. 3. Specifically, for example, the position information retaining portion 200 retains coordinate information of the sub-pixel 211 having the spacer placed therein in horizontal and vertical directions on the panel 205.

The control portion 201 includes a video signal selection portion 206 and a video signal conversion portion 207. The control portion 201 controls the source driver 204 based on a video signal input from an external device.

The video signal selection portion 206 selects the video signals corresponding to a pixel 210 including the sub-pixel 211 in which the spacer is placed from among the video signals corresponding to one frame based on the position-information retained by the position information retaining portion 200. Specifically, for example, the video signal selection portion 206 selects, from among the video signals corresponding to one frame, the video signal corresponding to a given sub-pixel 211 at coordinates retained by the position information retaining portion 200 and the video signal corresponding to another sub-pixel 211 included in one pixel 210 together with the given sub-pixel 211.

The video signal conversion portion 207 converts, for example, a given video signal selected by the video signal selection portion 206 into another video signal exhibiting a luminance higher than a luminance exhibited by the given video signal. The video signal conversion portion 207 is described later in detail.

The timing generation portion 202 controls timings of the gate driver 203 and the source driver 204 described later. Specifically, the timing generation portion 202 controls the gate driver 203 by outputting a gate driver 203 control signal to the gate driver 203 based on a resolution of the input video signal. Further, the timing generation portion 202 controls the source driver 204 by outputting a source driver 204 control signal to the source driver 204 based on the resolution of the input video signal.

In the panel 205, a plurality of gate lines 208 are arranged, and the gate lines 208 are connected to the gate driver 203. Further, in the panel 205, a plurality of video signal lines 209 are arranged so as to intersect the gate lines 208, and the video signal lines 209 are connected to the source driver 204. In addition, the panel 205 includes the pixels 210 segmented by the gate lines 208 and the video signal lines 209 in a matrix shape, and the pixels 210 each include a plurality of sub-pixels 211. A TFT 212, a pixel electrode 213, an opposing electrode (not shown), and a color filter (not shown) are arranged in each of the sub-pixels 211. The TFT 212 has a gate connected to the gate line 208, and has a source and a drain one of which is connected to the video signal line 209 and the other of which is connected to the pixel electrode 213.

The gate driver 203 includes a plurality of basic circuits (not shown) corresponding to a plurality of gate lines 208 on a one-to-one basis. Note that, each of the basic circuits includes a plurality of TFTs and capacitors, and outputs, to the corresponding gate line 208, a gate signal that has a high voltage in a corresponding gate scanning period (signal high period) and a low voltage in the remaining period (signal low period) during one frame period based on the video signal.

The source driver 204 includes a plurality of basic circuits (not shown) corresponding to a plurality of video signal lines 209 on a one-to-one basis. Each of the basic circuits includes a plurality of TFTs and capacitors, and applies a pixel voltage to each of the pixels 210 based on the video signal controlled by the control portion 201 through the plurality of video signal lines 209.

Next, a description is made of an outline of an operation performed by the pixel circuit having the above-mentioned configuration. The gate driver 203 outputs the gate signal to the gate of the TFT 212 through the gate line 208. In addition, the source driver 204 supplies a voltage of the video signal to the TFT 212, to which the gate signal is output, through the video signal line 209 based on a source driver control signal. Then, the voltage of the video signal is applied to the pixel electrode 213 through the TFT 212. In this case, a potential difference occurs between the pixel electrode 213 and the opposing electrode.

The source driver 204 controls the potential difference, to thereby control alignment of a liquid crystal layer (not shown) inserted between the pixel electrode 213 and an opposing electrode 412. Here, because light is guided into the liquid crystal layer from the backlight unit 103, by controlling the alignment or the like of the liquid crystal layer as described above, a quantity of the light from the backlight unit 103 is adjusted to display an image as a result.

Next, with reference to FIG. 3, a description is made of a plan view illustrating a schematic layout of the panel 205. As illustrated in FIG. 3, the panel 205 includes a plurality of pixels 210 including the first to third sub-pixels 211 arranged in a matrix shape. Specifically, for example, the sub-pixels 211 are arranged by being segmented in a matrix shape by the plurality of gate lines 208 and the plurality of video signal lines 209. The panel 205 includes the pixels 210 each including the first to third sub-pixels 211 on which color filters for hues different from one another are arranged with overlaps in a light exit portions 401. The light exit portion 401 and the color filter are described later. Note that, the number of sub-pixels 211 included in one pixel 210 is not limited to three, and may be one, two, four, or greater.

Each of the sub-pixels 211 includes the TFT 212. Specifically, for example, each of the sub-pixels 211 has the TFT 212 in the vicinity of an intersection of the gate line 208 and the video signal line 209. Further, the gate of the TFT 212 is connected to the gate line 208, and one of the source and the drain is connected to the video signal line 209, while the other is connected to the pixel electrode 213 through a drain electrode 300.

Further, the panel 205 includes one spacer 301 for a plurality of sub-pixels 211. For example, as illustrated in FIG. 3, one sub-pixel 211 of twenty-seven sub-pixels 211 includes the spacer 301, and is placed with an overlap with a region that is the light exit portion 401 if the spacer 301 is not placed.

Note that, the spacers placed in the panel 205 are not limited to ones having the same size, and spacers different in size may be placed. Specifically, for example, some of the spacers 301 may be set large and each placed with an overlap with the region that is the light exit portion 401 if the spacer 301 is not placed, while the other spacers may be set small and each placed so as not to change an area of the light exit portion 401.

Figure 4A:
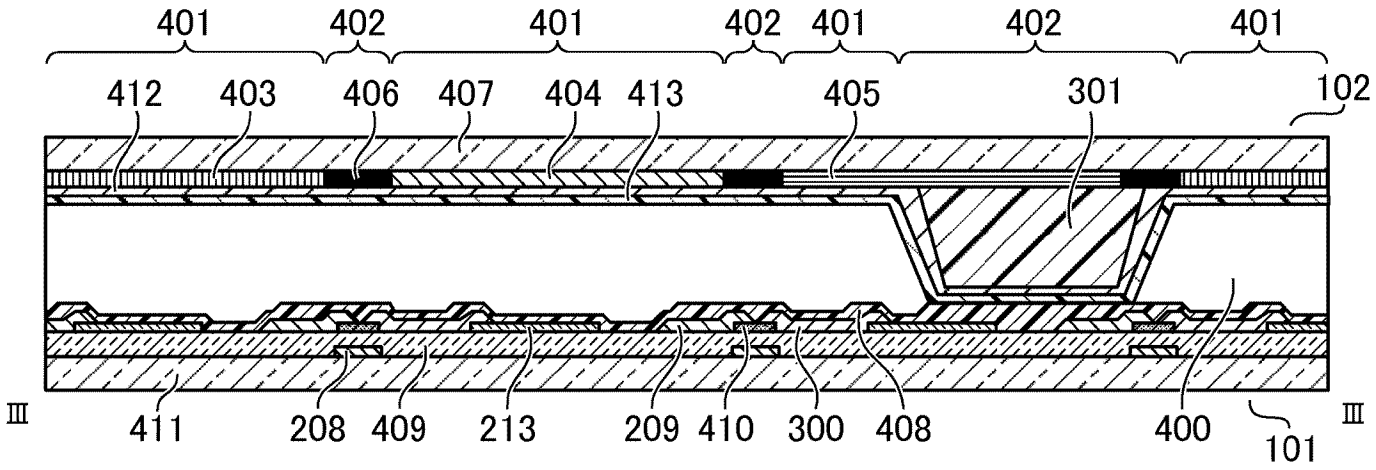
FIGS. 4A and 4B are sectional views illustrating the pixels of the liquid crystal display element according to the embodiment of the present application.
Figure 4B:
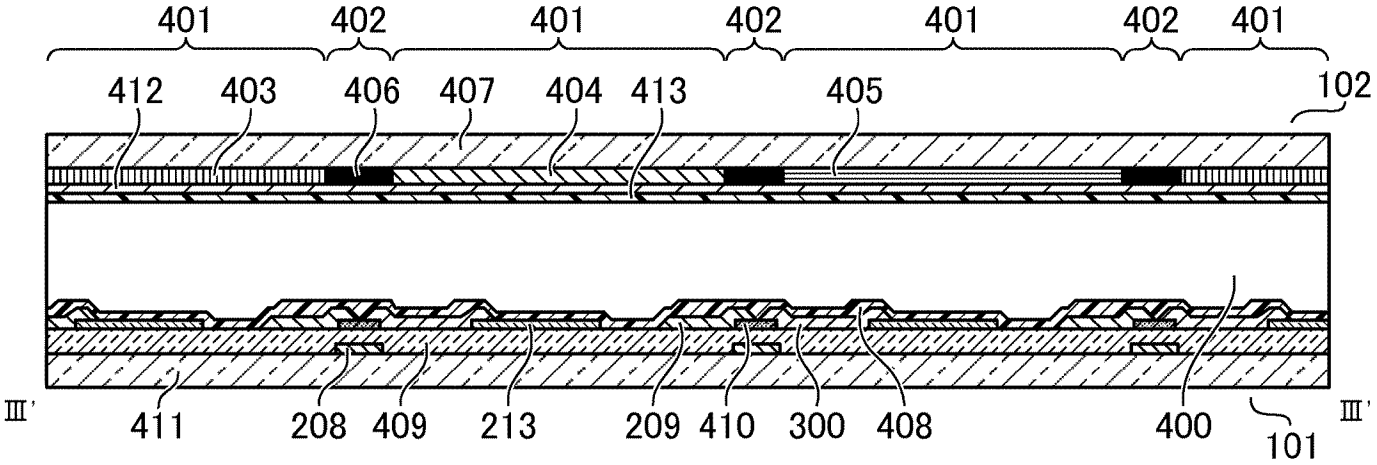

Next, with reference to FIG. 4A and FIG. 4B, a description is made of sectional views of the panel 205. FIG. 4A is a view illustrating a cross-section taken along the line III-III of FIG. 3, and illustrates a cross-section of a region in which the TFTs 212 of one pixel 210 having the spacer 301 placed therein are arranged. In the same manner, FIG. 4B is a view illustrating a cross-section taken along the line III'-III' of FIG. 3, and illustrates a cross-section of a region in which the TFTs 212 of one pixel 210 having no spacer 301 placed therein are arranged. As illustrated in FIG. 4A, the panel 205 includes the TFT substrate 101, a color filter substrate 102, and a liquid crystal layer 400 placed between the TFT substrate 101 and the color filter substrate 102.

First, a description is made of the light exit portion 401 and a boundary portion 402. Each of the sub-pixels 211 includes the light exit portion 401 and the boundary portion 402. The light exit portion 401 is a region in which any one of a red color filter 403, a green color filter 404, and a blue color filter 405 is placed in the color filter substrate 102, a light shielding member such as the spacer 301 is not placed, and light from the backlight unit 103 transmits toward a display surface side. On the other hand, the boundary portion 402 is a region in which a light shielding layer 406 or the spacer 301 is placed.

Next, a description is made of an example of a cross-section of the TFT substrate 101. The TFT substrate 101 includes: a first substrate 411; and the gate line 208, the video signal line 209, the drain electrode 300, the pixel electrode 213, a first alignment layer 408, a gate insulating layer 409, and a semiconductor layer 410, which are arranged on the first substrate 411. In the region of the light exit portion 401 included in each of the sub-pixels 211, the gate insulating layer 409, the pixel electrode 213, and the first alignment layer 408 are mainly placed on the TFT substrate 101 in the stated order on the color filter substrate 102 side with respect to the first substrate 411. On the other hand, the TFT 212 and the first alignment layer 408 are placed on the color filter substrate 102 side with respect to the first substrate 411 in the region in which the light shielding layer 406 is placed on the color filter substrate 102 side within the boundary portion 402 of the TFT substrate 101. Further, the TFT 212 includes the gate line 208, the gate insulating layer 409, the semiconductor layer 410, the video signal line 209, and the drain electrode 300.

Next, a description is made of an example of a cross-section of the color filter substrate 102. The color filter substrate 102 includes a second substrate 407, the color filters 403, 404, and 405, the light shielding layer 406, the opposing electrode 412, a second alignment layer 413, and the spacer 301. In the region of the light exit portion 401 included in each of the sub-pixels 211, the color filters 403, 404, and 405, the opposing electrode 412, and the second alignment layer 413 are placed on the color filter substrate 102 in the stated order on the TFT substrate 101 side. Further, the color filter includes the red color filter 403, the green color filter 404, and the blue color filter 405.

Note that, in the embodiment illustrated in FIG. 4A and FIG. 4B, the color filters 403, 404, and 405 represent color filters for hues of red, green, and blue, respectively, but the hues of the color filters included in one pixel 210 are not limited to the combination of red, green, and blue. The hues of the color filters included in one pixel 210 may include a combination of four colors such as red, green, blue, and white or a combination of red, green, blue, and yellow and other such combination.

Further, in the region in which the light shielding layer 406 is placed within the boundary portion 402 of each of the sub-pixels 211, the light shielding layer 406, the opposing electrode 412, and the second alignment layer 413 are placed in the stated order on the TFT substrate 101 side with respect to the second substrate 407. Further, in the boundary portion 402 in which the spacer 301 is placed among the boundary portions 402 of each of the sub-pixels 211, the light shielding layer 406 and any one of the color filters 403, 404, and 405 are placed on the TFT substrate 101 side with respect to the second substrate 407. Further, the spacer 301, the opposing electrode 412, and the second alignment layer 413 are placed in the stated order with overlaps with the light shielding layer 406 and the any one of color filters 403, 404, and 405.

The spacer 301 is placed, for one sub-pixel 211 of the plurality of sub-pixels 211, so as to be overlapped with the region that is the light exit portion 401 if the spacer 301 is not placed. For that reason, the area of the light exit portion 401 included in the sub-pixel 211 having the spacer 301 placed therein is smaller than the area of the light exit portion 401 included in the sub-pixel 211 having no spacer 301 therein. Note that, the light exit portions 401 included in the second sub-pixel 211 and the third sub-pixel 211 that have no spacer 301 therein have substantially the same area.

Note that, it is desired that the spacer 301 be placed in the sub-pixel 211 in which the color filter for the hue having the lowest visibility among the color filters for a plurality of hues is placed. In this case, the spacer 301 is placed so as to be overlapped with the light exit portion 401 of the sub-pixel 211 in which the color filter for the hue having the lowest visibility among the color filters for the respective hues different in visibility is placed, to thereby be able to alleviate a reduction in luminance caused by the spacer 301.

For example, in the embodiment of the present application, a visibility ratio of the respective colors of red, green, and blue is approximately blue:red:green=1.1:3:5, and the visibility of light exiting from the light exit portion 401 through the blue color filter 405 is the lowest among the color filters 403, 404, and 405 for the respective colors of red, green, and blue. Therefore, in a case where the spacer 301 is placed so as to be overlapped with the region of the blue sub-pixel 211 in which the light shielding member is not placed, the reduction in the luminance of the pixel 210 can be alleviated compared to a case where the spacer 301 is placed so as to be overlapped with the region of the red or green sub-pixel 211 in which the light shielding member is not placed. Note that, in the following description, the first sub-pixel 211 is set as the sub-pixel 211 in which the spacer 301 is placed and the light exit portion 401 has a smaller area, and the second and third sub-pixels 211 are each set as the sub-pixel 211 having no spacer 301 therein.

Specifically, as illustrated in FIG. 4A, the spacer 301 is placed so as to be overlapped with the region that is the light exit portion 401 if the spacer 301 illustrated in FIG. 4B is not placed. Further, the spacer 301 is placed in the sub-pixel 211 including the blue color filter 405 among the sub-pixels 211 in which the color filters 403, 404, and 405 for red, green, and blue, respectively, are placed. Note that, as illustrated in FIG. 4B, a plane and a cross-section of the blue sub-pixel 211 having no spacer 301 therein are equivalent to planes and cross-sections of the sub-pixels 211 in which the red and green color filters 403 and 404 are placed except for the hues of the color filters. Note that, the first and second alignment layers 408 and 413, the gate insulating layer 409, the polarizing plate, the light shielding layer 406, the color filters 403, 404, and 405, and the liquid crystal layer 400 are equivalent to those according to the prior art, and hence descriptions thereof are omitted.

Figure 5:
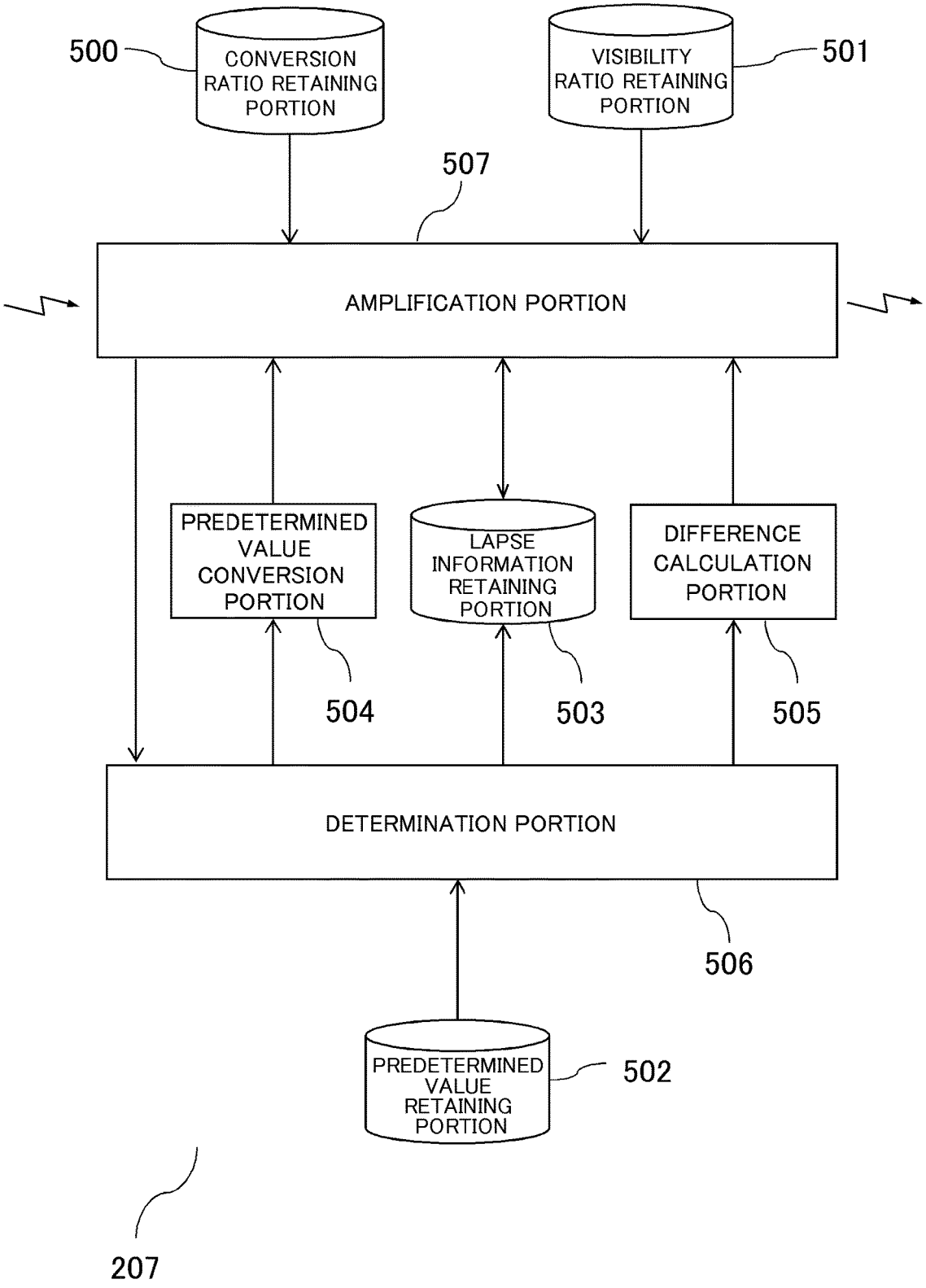
FIG. 5 is a diagram for illustrating an internal configuration of a video signal conversion portion illustrated in FIG. 2.

Next, with reference to FIG. 5, descriptions are made of components of the video signal conversion portion 207 and operations of the respective components. The video signal conversion portion 207 includes a conversion ratio retaining portion 500, a visibility ratio retaining portion 501, a predetermined value retaining portion 502, a lapse information retaining portion 503, a predetermined value conversion portion 504, a difference calculation portion 505, a determination portion 506, and an amplification portion 507.

The conversion ratio retaining portion 500 retains a ratio by which the area of the light exit portion 401 is reduced by having the spacer 301 placed therein, in other words, a ratio of the area of the light exit portion 401 (hereinafter referred to as "light exit area ratio"). Specifically, for example, assuming that the area of the light exit portion 401 of the sub-pixel 211 having no spacer 301 therein is 100 while the area of the light exit portion 401 of the sub-pixel 211 having the spacer 301 placed therein is 80, the conversion ratio retaining portion 500 retains a light exit area ratio of 80%. Note that, the conversion ratio retaining portion 500 may individually retain the light exit area ratios of the respective sub-pixels 211 of the plurality of sub-pixels 211 having the spacer 301 placed therein, or may retain the light exit area ratio common to all the sub-pixels 211.

The visibility ratio retaining portion 501 retains a ratio of the visibility (hereinafter referred to as "visibility ratio") of the light exiting from the light exit portion 401 through each color filter. Specifically, for example, in a case where the red, green, and blue color filters 403, 404, and 405 are placed in the respective sub-pixels 211 included in one pixel 210, the visibility ratio retaining portion 501 retains the visibility ratio of blue:red:green=1.1:3:5.

The predetermined value retaining portion 502 retains a predetermined value serving as an upper limit to which the source driver 204 can control each of the video signals corresponding to the respective sub-pixels 211 included in one pixel 210. For example, in a case where one pixel 210 includes the first to third sub-pixels 211, the predetermined value retaining portion 502 retains first to third predetermined values corresponding thereto, respectively. Note that, in a case where one pixel 210 includes one, two, four, or more sub-pixels 211, the predetermined values corresponding thereto on a one-to-one basis are retained. Specifically, for example, each video signal has a range of 0 to 255 gray level in an exemplary case where one pixel 210 includes three sub-pixels 211 of red, green, and blue and each video signal corresponding to each of the sub-pixels 211 is an 8-bit signal. For that reason, the predetermined values of first to third video signals are all 255 gray level. Note that, the predetermined value of the video signal may differ depending on the color. For example, the predetermined values of red and blue video signals may be 32 gray level, and the predetermined value of a green video signal may be 64 gray level.

The lapse information retaining portion 503 retains: the respective video signals input to the respective sub-pixels 211 included in one pixel 210; and information (hereinafter referred to as "color information") relating to a combination of the hues of the color filters placed in the respective sub-pixels 211. Specifically, for example, the lapse information retaining portion 503 retains each video signal and the color information corresponding to the video signal having a value less than the predetermined value in each process in which the amplification portion 507 described later performs amplification. In other words, the lapse information retaining portion 503 temporarily saves each video signal and the color information that change in each process. Further, a specific example of an operation of the lapse information retaining portion 503 is described later.

For example, when the determination portion 506 described later determines that the first to third video signals exceed the predetermined values, the predetermined value conversion portion 504 converts the video signals that exceed the predetermined values into the predetermined values of the first to third video signals corresponding thereto, respectively. Specifically, in a case where the blue video signal after conversion performed by the amplification portion 507 described later is 315 gray level and the predetermined value of the blue video signal is 255 gray level, the predetermined value conversion portion 504 converts the blue video signal into 255 gray level.

For example, in a case where the predetermined value conversion portion 504 converts the first to third video signals into the predetermined values, the difference calculation portion 505 calculates a difference between values of the video signals exceeding the first to third predetermined values and the first to third predetermined values corresponding thereto, respectively. For example, the difference calculation portion 505 calculates the difference of 60 gray level in the above-mentioned example in which the blue video signal after the conversion performed by the amplification portion 507 described later is 315 gray level and the predetermined value of the blue video signal is 255 gray level.

The determination portion 506 determines whether or not the respective video signals corresponding to the sub-pixels 211 of the respective colors, which have been converted by the amplification portion 507 described later, exceed the respective predetermined values. Specifically, for example, in a case where the blue video signal after the conversion performed by the amplification portion 507 is 300 gray level and the predetermined value of the blue video signal is 255 gray level, the determination portion 506 determines that the blue video signal after the conversion exceeds the predetermined value of the blue video signal.

The amplification portion 507 amplifies the luminance exhibited by the input video signal. Specifically, for example, the amplification portion 507 converts the video signal selected by the video signal selection portion 206 into the video signal exhibiting the luminance higher than the luminance exhibited by the selected video signal. In this case, the amplification portion 507 converts the video signal based on the light exit area ratio, the visibility ratio, a calculation result obtained by the difference calculation portion 505, or the color information retained by the lapse information retaining portion 503. Although the information used when the amplification portion 507 converts the video signal differs depending on the situation, a specific example of the conversion of the video signal performed by the amplification portion 507 in each situation is described below with reference to FIG. 6.

FIG. 6 shows each video signal corresponding to each of the sub-pixels 211 and the color information, which are retained by the lapse information retaining portion 503, in each process in which the amplification portion 507 amplifies the first to third video signals corresponding to the first to third sub-pixels 211 included in one pixel 210, respectively. Note that, in order to describe the above-mentioned specific example, it is assumed that one pixel 210 includes the first to third sub-pixels 211, the blue color filter 405 is placed in the first sub-pixel 211, the red color filter 403 is placed in the second sub-pixel 211, and the green color filter 404 is placed in the third sub-pixel 211. Further, it is assumed that the blue sub-pixel 211 has the spacer 301 placed therein, and the light exit area ratio is 80%. Further, it is assumed that the visibility ratio is blue:red:green=1.1:3:5. Further, it is assumed that the video signals selected by the video signal selection portion 206 are (blue, red, green)=(252, 250, 100) as shown in the second row of FIG. 6, and the predetermined values of the red, green, and blue video signals are all 255 gray level.

In addition, it is assumed that the video signal is directly proportional to the luminance, in other words, a γ characteristic representing a correlation between the video signal and the luminance is 1. The following description is made on the above-mentioned assumptions.

First, when the video signal selection portion 206 selects the respective video signals corresponding to one pixel 210, the amplification portion 507 converts the video signal corresponding to the first sub-pixel 211 having the spacer 301 placed therein among the respective video signals (first processing). In this case, based on the light exit area ratio, the amplification portion 507 converts the video signal into the first video signal exhibiting the luminance higher than the luminance exhibited by the first video signal before the first processing corresponding to the first sub-pixel 211. That is, the video signal is converted so that the luminance of the sub-pixel 211 having the spacer 301 placed therein is substantially the same as the luminance exhibited when the first video signal before the first processing is input to the sub-pixel 211 having no spacer 301 placed therein. By thus performing the conversion, the amplification portion 507 compensates the reduction in the luminance of the sub-pixel 211 caused by the presence of the spacer 301.

In the above-mentioned specific example, the amplification portion 507 converts the blue video signal of 252 gray level based on the light exit area ratio 80%. That is, the amplification portion 507 converts the video signal into the video signal of 315 gray level obtained by dividing the video signal of 252 gray level by 0.8. Note that, the amplification portion 507 does not convert the red or green video signal in the first processing. Therefore, as shown in FIG. 6, the lapse information retaining portion 503 after the first processing retains the respective video signals of (blue, red, green)=(315, 250, 100). Note that, as described later with reference to a flowchart, after the subsequent determination performed by the determination portion 506, before a second processing, the predetermined value conversion portion 504 converts the blue video signal of 315 gray level, which exceeds the predetermined value after the first processing, into the predetermined value of the blue video signal that is 255 gray level.

Further, in the above-mentioned specific example, the determination portion 506 determines that the blue video signal exceeds the predetermined value of the blue video signal, and hence the lapse information retaining portion 503 deletes the information indicating blue from the color information indicating blue, red, and green retained from an initial state. Therefore, as shown in FIG. 6, the lapse information retaining portion 503 after the first processing retains the color information indicating red and green.

Subsequently, the determination portion 506 performs determination for the first video signal corresponding to the first sub-pixel 211 after the first processing, and when it is determined by the determination portion 506 that the first video signal corresponding to the first sub-pixel 211 after the first processing exceeds the predetermined value, the amplification portion 507 converts the second and third video signals corresponding to the second and third sub-pixels 211 into the video signals exhibiting the luminance higher than the luminances exhibited by the second and third video signals (second processing). In this case, the amplification portion 507 converts the second and third video signals based on the visibility ratio and a relationship between the first video signal after the conversion performed in the first processing and a first predetermined value.

Specifically, for example, the amplification portion 507 evenly divides the luminance indicated by the difference between the first predetermined value and the first video signal after the first processing by the number of sub-pixels 211 other than the first sub-pixel 211. The video signals to be input to the sub-pixels 211 other than the first sub-pixel 211 are converted so that the luminances of the sub-pixels 211 other than the first sub-pixel 211 are each increased so as to correspond to the evenly-divided luminance. By this conversion, the reduction in the luminance caused by the presence of the spacer 301 can be compensated in units of the pixels 210 even when the luminance of the pixel 210 cannot be compensated only by converting the first video signal.

Note that, the description is made of the case where the difference between the first predetermined value and the first video signal is evenly divided, but the present invention is not limited to the case where the difference is evenly divided, and the luminance of a specific sub-pixel may be preferentially amplified. For example, in a case where one pixel includes the sub-pixels of the four colors of red, green, blue, and white, when the above-mentioned second processing is performed, only the sub-pixel of white may be increased in luminance by an amount of the luminance indicated by the difference between the blue video signal exceeding the predetermined value and the predetermined value. In this case, it is possible to alleviate a change in the hue compared to the case of increasing the luminances exhibited by the red and green video signals. Note that, when the determination portion 506 determines that the predetermined value is not exceeded, the second processing and a third processing described later are not performed.

In the above-mentioned specific example, the amplification portion 507 converts the red video signal of 250 gray level and the green video signal of 100 gray level. In this case, the difference between the blue video signal of 315 gray level and the first predetermined value of 255 is 60 gray level, and based on the amount of the luminance exhibited by the blue video signal of 60 gray level, the luminance exhibited by the red video signal of 250 gray level and the luminance exhibited by the green video signal of 100 gray level are amplified. At this time, in order to evenly amplify the luminances of the red sub-pixel 211 and the green sub-pixel 211, the amplification portion 507 adds the evenly-divided luminance exhibited by the blue video signal of 60 gray level to the luminances of the red and green sub-pixels 211.

Here, the visibility ratio of red and blue is red:blue=3:1.1, and hence the luminance of half the luminance exhibited by the blue video signal of 60 gray level corresponds to the luminance exhibited by the red video signal of 11 gray level. Therefore, the amplification portion 507 converts the red video signal of 250 gray level into 261 gray level. In the same manner, the visibility ratio of green and blue is green:blue=5:1.1, and hence the luminance of half the luminance exhibited by the blue video signal of 60 gray level corresponds to the luminance exhibited by the green video signal of 6.6 gray level. Here, a gray level takes an integer value, and hence the amplification portion 507 performs round-off or the like as appropriate. For that reason, the amplification portion 507 converts the green video signal of 100 gray level into 107 gray level. Therefore, as shown in FIG. 6, the respective video signals after the second processing are (blue, red, green)=(255, 261, 107). Note that, as described later with reference to a flowchart, after the subsequent determination performed by the determination portion 506, before the third processing, the predetermined value conversion portion 504 converts the red video signal of 261 gray level, which exceeds the predetermined value after the second processing, into the predetermined value of the red video signal that is 255 gray level.

Further, in the above-mentioned specific example, the determination portion 506 determines that the red video signal exceeds the predetermined value of the red video signal, and hence the lapse information retaining portion 503 deletes the information indicating red from the color information indicating red and green retained after the first processing. Therefore, as shown in FIG. 6, the lapse information retaining portion 503 after the second processing retains the color information indicating green.

Subsequently, the determination portion 506 performs determination for the second and third video signals after the second processing, and when it is determined by the determination portion 506 that one of the second and third video signals exceeds the second or third predetermined value, the amplification portion 507 converts the other video signal into the video signal exhibiting the luminance higher than the luminance exhibited by the other video signal (third processing). In this case, the amplification portion 507 converts the second or third video signal based on a relationship between the second or third video signal after the conversion performed in the second processing and the second or third predetermined value, the visibility ratio, and the color information retained by the lapse information retaining portion 503. Note that, when the determination portion 506 determines that both the second and third video signals exceed the predetermined values or when the determination portion 506 determines that neither the second nor third video signal exceeds the predetermined value, the third processing is not performed.

In the above-mentioned specific example, the difference between the red video signal of 261 gray level and the predetermined value of the red video signal of 255 is 6 gray level, and the visibility ratio of red and green is red:green=3:5, and hence the luminance exhibited by the red video signal of 6 gray level corresponds to the luminance exhibited by the green video signal of 3.6 gray level. Here, the gray level takes an integer value, and hence the amplification portion 507 performs round-off or the like as appropriate, while the lapse information retaining portion 503 retains the color information indicating green, and hence the green video signal of 107 gray level is converted into 111 gray level. Therefore, as shown in FIG. 6, the respective video signals after the third processing are (blue, red, green)=(255, 255, 111).

Note that, when there is a video signal exceeding the predetermined value after the third processing, the predetermined value conversion portion 504 converts the video signal exceeding the predetermined value into the predetermined value. In the above-mentioned specific example, the green video signal is 111 gray level and does not exceed the predetermined value of the green video signal of 255, and hence the predetermined value conversion portion 504 does not convert the green video signal. Therefore, the source driver uses the video signals of (blue, red, green)=(255, 255, 111) after the conversion to apply the pixel voltage to each of the sub-pixels included in one pixel selected by the video signal selection portion 206.

Figure 7:
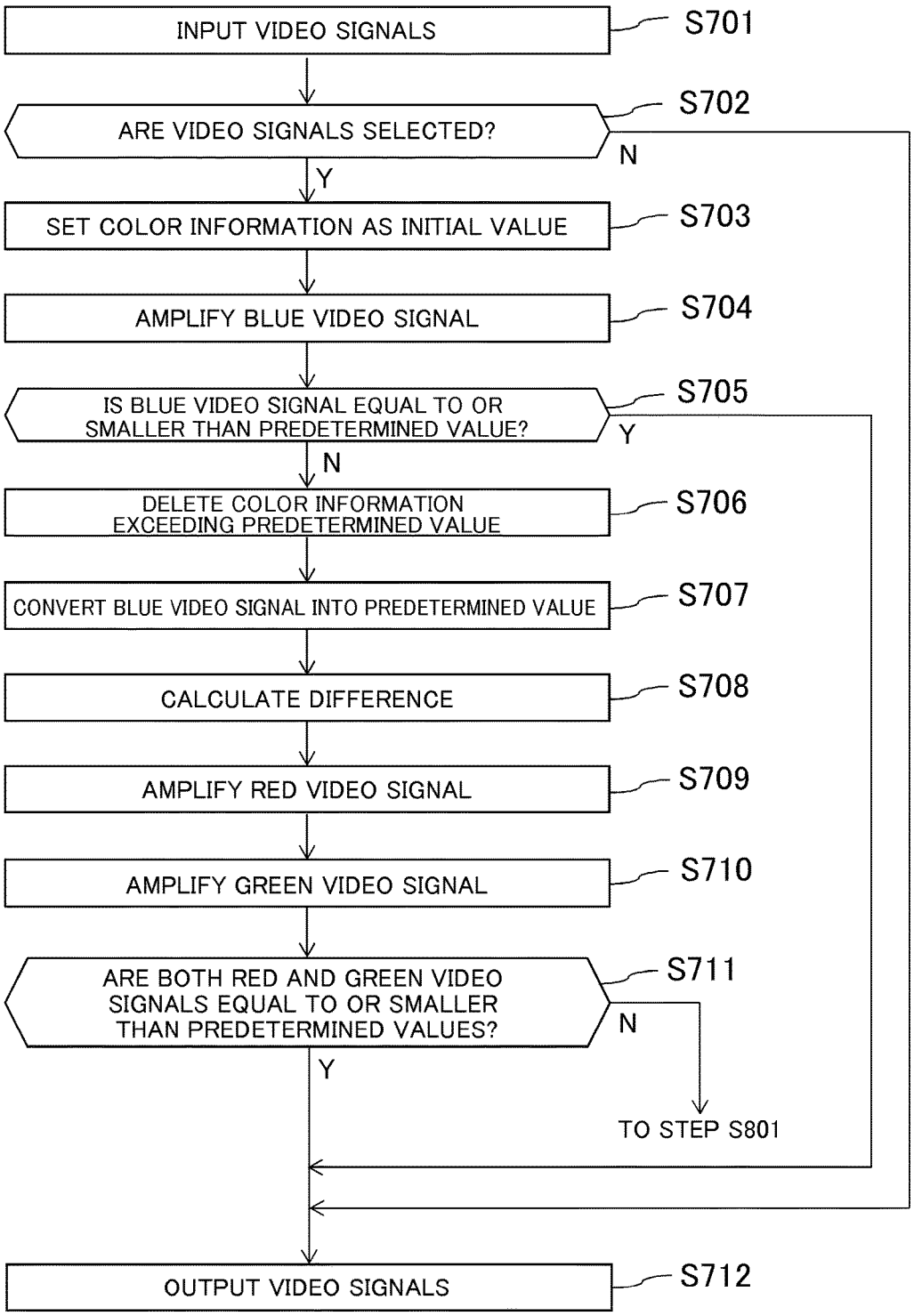
FIG. 7 is a diagram illustrating a processing flow performed by the video signal conversion portion.
Figure 8:
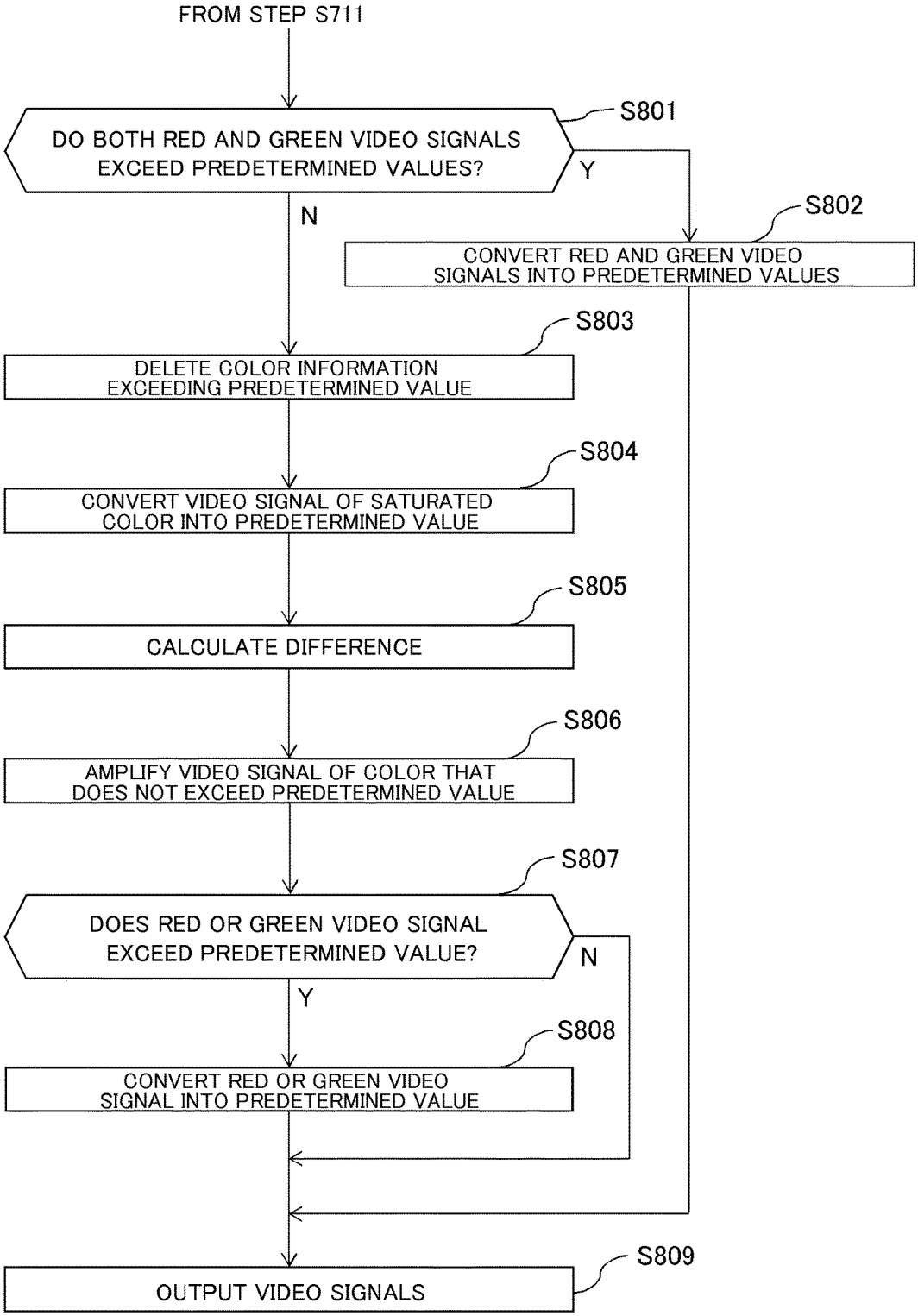
FIG. 8 is a diagram illustrating the processing flow performed by the video signal conversion portion.

Next, with reference to FIG. 7 and FIG. 8, an operation of the video signal conversion portion 207 is described by using the same specific example as described above. First, the video signals corresponding to one frame are input to the video signal selection portion 206 from, for example, the external device (S701).

Subsequently, based on the position information retained by the position information retaining portion 200, the video signal selection portion 206 selects the video signals corresponding to the pixel 210 including the sub-pixel 211 having the spacer 301 placed therein from among the video signals corresponding to one frame (S702). In the above-mentioned specific example, the video signal selection portion 206 selects the video signals of (blue, red, green)=(252, 250, 100) corresponding to one pixel. Note that, the video signals that are not selected are output to the source driver 204 without any change from the state input from the external device (S712).

Subsequently, the lapse information retaining portion 503 retains the color information relating to the combination of colors of the color filters placed in the respective sub-pixels 211 included in one pixel 210 (S703). In the above-mentioned specific example, the color information relating to the combination of red, green, and blue is retained.

Subsequently, based on the light exit area ratio, the amplification portion 507 converts the first video signal corresponding to the first sub-pixel 211 having the spacer 301 placed therein among the video signals selectedby the video signal selection portion 206 (S704). In the above-mentioned specific example, the amplification portion 507 converts the blue video signal of 252 gray level into the blue video signal of 315 gray level based on the light exit area ratio of 80%.

Subsequently, the determination portion 506 determines whether or not the video signal converted by the amplification portion 507 in S704 exceeds the predetermined value (S705). When the video signal after the conversion exceeds the predetermined value, the procedure advances to S706, and otherwise, the procedure advances to S712. In the above-mentioned specific example, 315 gray level are larger than 255 gray level, and hence the determination portion 506 determines that the video signal after the conversion exceeds the predetermined value. Note that, when it is determined in S705 that the first video signal after the conversion does not exceed the first predetermined value, the first to third video signals are output to the source driver 204 (S712).

Subsequently, when the determination portion 506 determines in S705 that the first video signal after the conversion exceeds the first predetermined value, the lapse information retaining portion 503 deletes the color information on the color filter placed in the sub-pixel 211 corresponding to the first video signal in S705 (S706). In the above-mentioned specific example, the blue video signal becomes saturated, and hence the lapse information retaining portion 503 deletes the color information indicating blue from the color information indicating red, green, and blue. As a result, the lapse information retaining portion 503 retains the color information indicating red and green.

Subsequently, the predetermined value conversion portion 504 converts the first video signal that exceeds the predetermined value into the first predetermined value (S707). In the above-mentioned specific example, the determination portion 506 determines in S705 that the blue video signal exceeds the predetermined value of the blue video signal, and hence the predetermined value conversion portion 504 converts the blue video signal of 315 gray level into the predetermined value of the blue video signal that is 255 gray level.

Subsequently, the difference calculation portion 505 calculates the difference between the first video signal exceeding the first predetermined value before being converted by the predetermined value conversion portion 504 in S707 and the first predetermined value (S708). In the specific example, the difference calculation portion 505 calculates the difference of 60 gray level between the blue video signal of 315 gray level and the predetermined value of the blue video signal that is 255 gray level.

Subsequently, the amplification portion 507 converts the second and third video signals before S709 into the second and third video signals exhibiting the luminances higher than the luminances exhibited by the second and third video signals before S709 (S709 and S710). In the above-mentioned specific example, the amplification portion 507 converts the red video signal of 250 gray level into 261 gray level, and converts the green video signal of 100 gray level into 107 gray level.

Subsequently, the determination portion 506 determines whether or not the second and third video signals converted by the amplification portion 507 in S709 and S710 exceed the second and third predetermined values (S711 and S801). Note that, S711 and S801 are separately described for the sake of convenience in illustrating the flowchart, but the determination portion 506 simultaneously performs the processing of S711 and S801. When neither the second nor third video signal after the conversion performed in S709 and S710 exceeds the second or third predetermined values, the procedure advances to S712, when both the second and third video signals exceed the predetermined values, the procedure advances to S802, and when one video signal of the second and third video signals exceeds the predetermined value corresponding thereto, the procedure advances to S803.

When the procedure advances to S712, the first to third video signals are output to the source driver 204. When the procedure advances to S802, the second and third video signals are converted into the second and third predetermined values, respectively, and output to the source driver 204. In the above-mentioned specific example, the red video signal of 260 gray level exceeds the predetermined value of the red video signal of 255, while the green video signal of 107 gray level does not exceed the predetermined value of the green video signal of 255, and hence the determination portion 506 determines that one video signal of the second and third video signals exceeds the predetermined value corresponding thereto. Therefore, the procedure advances to S803.

Subsequently, when the determination portion 506 determines in S711 and S801 that one video signal of the second and third video signals exceeds the predetermined value corresponding thereto, the lapse information retaining portion 503 deletes the color information corresponding to the video signal determined as exceeding the predetermined value in S711 and S801 (S803). In the above-mentioned specific example, the red video signal is determined as exceeding the predetermined value of the red video signal, and hence the lapse information retaining portion 503 deletes the color information indicating red from the color information indicating red and green retained before S803.

Subsequently, the predetermined value conversion portion 504 converts the video signal determined as exceeding the predetermined value in S711 and S801 into the predetermined value corresponding thereto (S804). In the above-mentioned specific example, the determination portion 506 determines in S711 and S801 that the red video signal exceeds the predetermined value of the red video signal, and hence the predetermined value conversion portion 504 converts the red video signal of 261 gray level into 255 gray level. Subsequently, the difference calculation portion 505 calculates the difference from the video signal converted by the predetermined value conversion portion 504 in S804 (S805). In the above-mentioned specific example, the difference calculation portion 505 calculates the difference of 6 gray level between the red video signal of 261 gray level and 255 gray level.

Subsequently, the amplification portion 507 converts one of the second and third video signals that is determined in S711 and S801 as not exceeding the predetermined value based on the information retained by the lapse information retaining portion 503 and the calculation result obtained in S805 by the difference calculation portion 505 (S806). In the above-mentioned specific example, the lapse information retaining portion 503 retains the green color information, and hence the amplification portion 507 converts the green video signal of 107 gray level into 111 gray level.

Subsequently, the determination portion 506 determines whether or not the second or third video signal converted in S806 exceeds the predetermined value corresponding thereto (S807). When it is determined in S807 that the second or third video signal exceeds the second or third predetermined value, the predetermined value conversion portion 504 converts the second or third video signal determined as exceeding the predetermined value into the predetermined value corresponding thereto (S808).

When it is determined in S807 that the second or third video signal does not exceed the predetermined value corresponding thereto, the first to third video signals are output to the source driver 204 (S809). In the above-mentioned specific example, none of the video signals after the conversion exceeds the predetermined value, and hence the video signals of (blue, red, green)=(255, 255, 111) are output to the source driver 204.

Note that, the above-mentioned description is directed to the case where the video signals are converted for one pixel having the spacer placed therein, but a video signal conversion portion performs the same video signal conversion as described above for another pixel having the spacer placed therein. On the other hand, the video signals input to the pixel having no spacer placed therein are not selected by the video signal selection portion 206, and hence the video signal conversion portion does not perform the same video signal conversion as described above for the video signals input to the pixel having no spacer placed therein. Therefore, in a case where the video signals exhibiting a fixed luminance less than the predetermined value are input to the pixel having the spacer placed therein and the pixel having no spacer placed therein, the source driver 204 outputs the video signals exhibiting a higher luminance to the pixel having the spacer placed therein than that of the video signals to be output to the pixel having no spacer placed therein.

As described above, the video signal conversion portion 207 alleviates the reduction in the luminance and display unevenness caused by the spacer 301 by converting the video signals of the pixel 210 to which the sub-pixel 211 having the spacer 301 therein belongs. The present invention is not limited to the above-mentioned embodiment, and various modifications can be made. For example, the configuration illustrated in the above-mentioned embodiment can be replaced by substantially the same configuration, a configuration producing the same operation effects, or a configuration capable of achieving the same object.

Specifically, for example, the above-mentioned specific example is described above on the assumption that they characteristic is 1, but in actuality, the γ characteristic may be 2.2 or may be another value. However, in a case where the γ characteristic is not 1, the amplification portion 507 performs the video signal conversion so as to exhibit the same degree of amplification of the luminance as in the case where the γ characteristic is 1.

Figure 9:
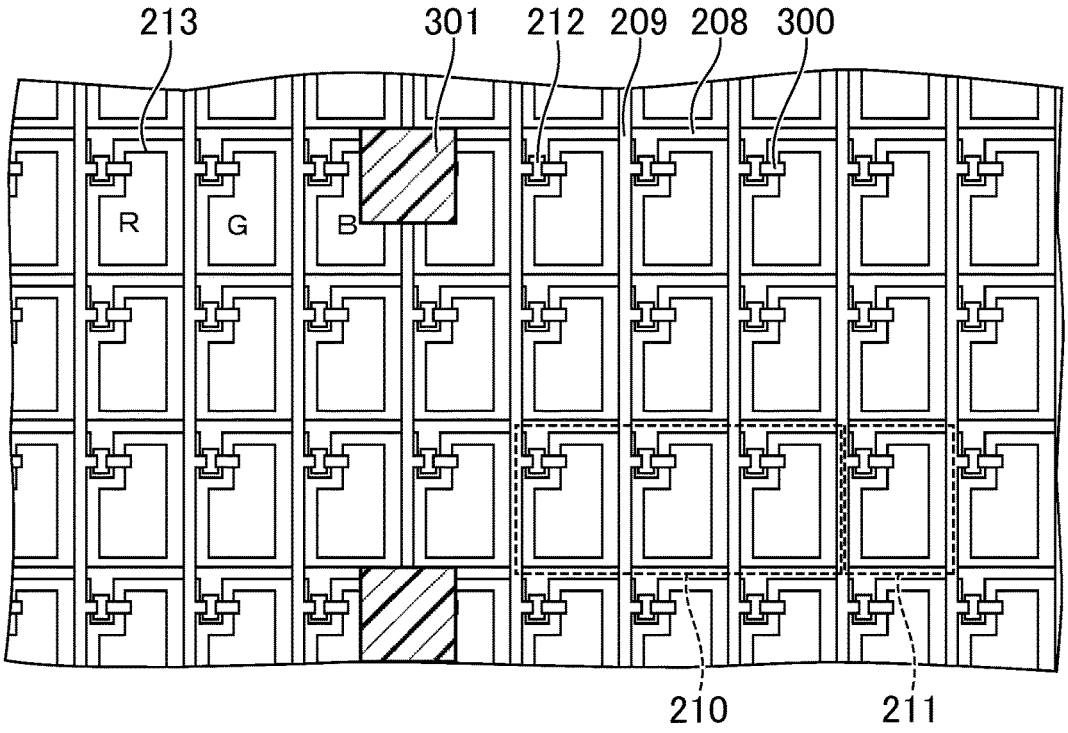
FIG. 9 is a plan view illustrating pixels of a liquid crystal display element according to another embodiment of the present application.

Further, the above-mentioned description is directed to the case where the blue sub-pixel 211 has the spacer 301 placed therein, but the present invention is not limited thereto. For example, the red or green sub-pixel 211 may have the spacer 301 placed therein, or as illustrated in FIG. 9, the spacer 301 may be placed in the red sub-pixel 211 as well as in the blue sub-pixel 211. Alternatively, other combinations may be employed. In a configuration in which a plurality of sub-pixels 211 among the sub-pixels 211 that form one pixel 210 have the spacers 301 placed therein, the amplification portion 507 converts the video signals corresponding to the respective sub-pixels 211 based on a reduction ratio of the area of the light transmission portion caused by the spacers 301 placed in each of the sub-pixels 211.

In addition, the above-mentioned description is directed to the case where one pixel 210 is formed of the sub-pixels 211 of the three colors of red, green, and blue. However, the present invention is not limited to the case where one pixel 210 is formed of the sub-pixels 211 of the three colors of red, green, and blue, and one pixel 210 may be formed of the sub-pixels 211 of four colors such as red, green, blue, and white or red, green, blue, and yellow by adding the sub-pixel 211 of white or yellow. Further, one pixel 210 may be formed of the sub-pixels 211 of five or more colors.

Further, the interference portion described in the claims corresponds to, for example, the above-mentioned spacer 301. However, the interference portion is not limited to the spacer, and may be a sensor or the like. Specifically, for example, a photosensor for sensing an intensity of an external light incident to the panel 205 from an opposite side of the backlight unit 103 may be placed instead of the spacer 301. Note that, the sensor is not limited to the photosensor, and may be another sensor such as a sensor for sensing a change in electrostatic capacity.

Further, although the liquid crystal display device has been described above, the display device may be a display device using various types of light-emitting elements such as organic EL elements, inorganic EL elements, and field-emission devices (FEDs). Further, the display device 100 described above can be used as various types of display devices for displaying information such as a display for personal computer, a display for TV broadcast reception, or a display for advertisement display. Moreover, the display device 100 can also be used as a display section of various electronic devices such as a digital still camera, a video camera, a car navigation system, a car audio system, a game machine, and a personal digital assistant.

What is claimed is:

1. A display device, comprising:

a display in which a plurality of pixels comprising a first pixel and a second pixel are arranged in a matrix shape;

a source driver for applying a pixel voltage to the plurality of pixels through a plurality of signal lines; and a controller that controls the source driver based on a video signal input from outside, the first pixel and the second pixel each comprising a first sub-pixel, a second sub-pixel, and a third sub-pixel different from the first sub-pixel and the second sub-pixel, the first sub-pixel comprising:

a light exit portion from which light exits; and a color filter for a first hue, the second sub-pixel comprising:

the light exit portion; and a color filter for a second hue, the third sub-pixel comprising:

a color filter for a third hue different from the first hue and the second hue, wherein:

an area of the light exit portion included in the first sub-pixel of the first pixel is smaller than an area of the light exit portion included in the first sub-pixel of the second pixel;

an area of the light exit portion included in the second sub-pixel of the first pixel is substantially equal to an area of the light exit portion included in the second sub-pixel of the second pixel;

the controller converts, when the video signal input to the first sub-pixel of the first pixel is less than a predetermined value, the video signal input to the first sub-pixel of the first pixel into a video signal exhibiting a luminance higher than a luminance exhibited by the video signal input to the first sub-pixel;

the source driver applies the pixel voltage to the first sub-pixel of the first pixel based on the video signal after conversion; and the controller converts, when the video signal input to the first sub-pixel of the first pixel after the conversion exceeds the predetermined value, the respective video signals input to the second sub-pixel and the third sub-pixel of the first pixel into respective video signals exhibiting luminances higher than luminances exhibited by the respective video signals input to the second sub-pixel and the third sub-pixel.

2. The display device according to claim 1, wherein the controller converts the respective video signals input to the second sub-pixel and the third sub-pixel of the first pixel based on a relationship between the video signal exceeding the predetermined value and the predetermined value.

3. The display device according to claim 1, wherein the controller converts, when one of the video signals input to the second sub-pixel and the third sub-pixel of the first pixel after the conversion exceeds a predetermined value, the other of the video signals input to the second sub-pixel and the third sub-pixel into a video signal exhibiting a luminance higher than a luminance exhibited by the other of the video signals.

4. The display device according to claim 3, wherein the controller converts the other of the video signals input to the second sub-pixel and the third sub-pixel based on a relationship between the one of the video signals input to the second sub-pixel and the third sub-pixel and the predetermined value.

5. The display device according to claim 1, wherein the controller converts, based on a ratio of visibilities of the color filters for the first hue, the second hue, and the third hue, the respective video signals input to the second sub-pixel and the third sub-pixel of the first pixel into respective video signals exhibiting the luminances higher than the luminances exhibited by the respective video signals input to the second sub-pixel and the third sub-pixel.

6. The display device according to claim 1, wherein:

the first sub-pixel of the first pixel further comprises an interference portion for inhibiting the light from exiting; and the interference portion causes the area of the light exit portion of the first sub-pixel of the first pixel to be smaller than the area of the light exit portion of the first sub-pixel of the second pixel.

7. The display device according to claim 6, further comprising a first substrate and a second substrate, wherein the interference portion is a spacer placed between the first substrate and the second substrate.

8. The display device according to claim 6, wherein the interference portion is a sensor.

9. The display device according to claim 1, wherein the first hue is blue.

10. A display device, comprising:

a display in which a plurality of pixels comprising a first pixel and a second pixel are arranged in a matrix shape;

a source driver for applying a pixel voltage to the plurality of pixels through a plurality of signal lines; and a controller that controls the source driver based on a video signal input from outside, the first pixel and the second pixel each comprising a first sub-pixel and a second sub-pixel, the first sub-pixel comprising:

a light exit portion from which light exits; and a color filter for a first hue, the second sub-pixel comprising:

the light exit portion; and a color filter for a second hue, wherein:

an area of the light exit portion included in the first sub-pixel of the first pixel is smaller than an area of the light exit portion included in the first sub-pixel of the second pixel;

the controller converts, when the video signal exhibiting a fixed luminance less than a first predetermined value is input from the outside to the first sub-pixel included in each of the first pixel and the second pixel, the video signal input to the first sub-pixel of the first pixel into a video signal exhibiting a luminance higher than a luminance exhibited by the video signal input to the first sub-pixel of the second pixel; and the source driver applies the pixel voltage to the first sub-pixel of the first pixel based on the video signal after conversion.

11. The display device according to claim 10, wherein:

an area of the light exit portion included in the second sub-pixel of the first pixel is substantially equal to an area of the light exit portion included in the second sub-pixel of the second pixel;

the controller converts, when the video signal after the conversion which is input to the first sub-pixel of the first pixel is the video signal exhibiting a luminance of the first predetermined value and when the video signal exhibiting a fixed luminance less than a second predetermined value is input to each of the second sub-pixels included in the first pixel and the second pixel, the video signal input to the second sub-pixel of the first pixel into a video signal exhibiting a luminance higher than a luminance exhibited by the video signal input to the second sub-pixel of the second pixel; and the source driver applies the pixel voltage to the second sub-pixel of the first pixel based on the video signal after the conversion.

* * * * *